US005240152A

United States Patent [19]

Scholz

[11] Patent Number: 5,240,152

[45] Date of Patent: Aug. 31, 1993

[54] DISPENSER WITH AN ENERGY STORAGE MEMBER

[75] Inventor: Michael P. Scholz, San Clemente, Calif.

[73] Assignee: Williams Dispenser Corporation, Los Angeles, Calif.

[21] Appl. No.: 906,667

[22] Filed: Jun. 30, 1992

[51] Int. Cl.[5] ..... B65D 88/54

[52] U.S. Cl. ..... 222/336; 222/183; 222/326; 222/390

[58] Field of Search ..... 222/95, 336, 340, 183, 222/321, 337, 386, 390, 389, 325-327; 239/320, 321, 324

[56] References Cited

U.S. PATENT DOCUMENTS 1,443,910 1/1923 Zearing, Jr. et al. .
1,476,946 12/1923 Bessesen .
1,664,936 4/1928 Lyman .
2,728,097 12/1955 Seifert .
3,195,168 7/1965 Roberts .
3,951,310 4/1976 Steiman .
5,042,696 8/1991 Williams .
5,139,178 8/1992 Arch et al. ..... 222/386 X
5,143,259 9/1992 Williams ..... 222/390 X

*Primary Examiner*—Gregory L. Huson
*Attorney, Agent, or Firm*—Burns, Doane, Swecker & Mathis

[57] ABSTRACT

A dispenser comprises a container, a product-containing bag disposed within the container, and a valve for discharging product from the bag. A piston is disposed beneath the bag and is raisable by a manually rotatable post which is threadedly connected to a central through-hole of the piston. A closed-cell foam element is disposed between the piston and the bag and is elastically compressed when the piston is raised, in order to store energy and pressurize the contents of the bag. A stiff disc is disposed between the foam element and the bag and includes a central through-hole. The threaded post extends upwardly through the piston, the foam element, and the disc, and terminates within a downwardly open cavity formed in the bag. The valve and bag are connected to the container to be removed therefrom as a unit and replaced by a similar refill unit.

22 Claims, 1 Drawing Sheet

DISPENSER WITH AN ENERGY STORAGE MEMBER

BACKGROUND OF THE INVENTION

The present invention relates to a dispenser, especially a hand-held spray dispenser in which a spray is emitted upon manual actuation of a valve.

For many years spray dispensers for dispensing products such as hair spray, deodorants, room air fresheners, etc., have utilized a container in which the product is stored in liquid form. A propellant gas under pressure occupies a head space between the top of the container and the liquid product. A dip tube extends downwardly through the propellant and product from a discharge valve located at the top of the container. When a user opens the discharge valve, the propellant pushes the liquid product into the bottom of the dip tube and then upwardly through the dip tube to the valve.

Propellant gases which have commonly been used have included butane and pentane, for example. Those gases feature the ability to become dissolved within the liquid product under the usual pressure conditions occurring within the container. Hence, the product is discharged in the form of liquid particles mixed with bubbles of the propellant gas. When exposed to the lower atmospheric pressure, those bubbles expand suddenly to advantageously break up the liquid particles into a finer spray pattern.

The conventional propellant gases have exhibited ideal product-expelling characteristics, i.e., an essentially constant pressure of a specified magnitude which can be maintained continuously for a specified duration of time.

More recently, however, due to concerns about environmental pollution, conventional propellant gases have fallen into disfavor. Alternative sources of propulsion have been sought which will satisfy the above-mentioned product-expelling characteristics without being accompanied by the discharge of polluting gases.

Dispensers have heretofore been proposed which employ an internal energy-storing member capable of being mechanically compressed by a rotatable actuator to pressurize a liquid product, e.g., see U.S. Pat. No. 3,195,168 which proposes to use an energy-storing member in the form of a coil spring. However, coil springs are not ideally suited to continuously produce a constant pressure for a sufficiently long duration to satisfy most spraying requirements.

In Williams U.S. Pat. No. 5,042,696 a multi-piece piston is disclosed which comprises a product ejecting member and an energizing member separated by a gas-filled space. The energizing member is raisable by rotation of an outer sleeve which raises a portion that is threadedly connected to the sleeve. The piston compresses the gas while pressurizing the product, which is located above the ejecting member. The compressed gas acts as a gas spring to store energy. That energy is gradually released to eject the product when a discharge valve is opened by a user. Once the gas pressure has been dissipated, the outer sleeve is rotated to recompress the gas. This mechanism has been shown to provide a generally uniform pressure which can be maintained continuously at a sufficiently high magnitude for a suitable duration.

However, shortcomings remain, especially regarding the production of storable energy in a manner which is convenient to the user, i.e., the ability to compress the energy storing medium rapidly and with a minimum amount of force.

SUMMARY OF THE INVENTION

The present invention relates to a dispenser which comprises a container and a valving mechanism mounted at an upper longitudinal end of the container. The valving mechanism includes a discharge outlet. A liquid product-containing flexible bag is disposed in the container such that liquid product therein communicates with the discharge outlet. A piston is disposed in the container below the bag for non-rotational longitudinal movement. The piston includes an internally threaded central through-hole. An elastically deformable closed-cell foam element is disposed in the container between the bag and the piston. The foam element includes a central through-hole. A manual actuating mechanism is provided for raising the piston and includes a drive portion and a post. The drive portion is exposed for manual rotation about a longitudinal axis adjacent a lower end of the container. The post is externally threaded and is joined to the drive portion. The post extends longitudinally upwardly through the through-holes of the piston and the foam element. An upper end of the post terminates within a cavity disposed in a lower end of the bag. The post is threadedly connected to the internally threaded through-hole of the piston such that rotation of the post in one direction raises the piston to compress the foam element and pressurize liquid product in the bag.

Preferably, the valving mechanism and the bag are removable as a unit from the container and are replaceable by a similar unitary valving mechanism and bag.

Preferably, a cap is threadedly connected to an upper end of the container. The valving mechanism and bag are connected to the cap such that the cap is removable as a unit with the valving mechanism and bag.

Preferably, the bag has a bellows configuration.

The drive portion of the actuating mechanism preferably comprises a sleeve arranged coaxially relative to the container around an outer periphery thereof. An inner surface of the sleeve includes a downwardly facing shoulder. The outer periphery of the container includes an upwardly facing surface disposed beneath the downwardly facing shoulder for retaining the sleeve against longitudinal dislodgement from the container while permitting the sleeve to rotate relative to the container about the longitudinal axis.

A stiff disc is preferably interposed between an upper end of the foam element and a lower end of the bag to prevent the lower end of the bag from being pinched by the foam element.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which.

DETAILED DESCRIPTION OF A PREFERRED EMBODIMENT OF THE INVENTION

Figures 1, 2:
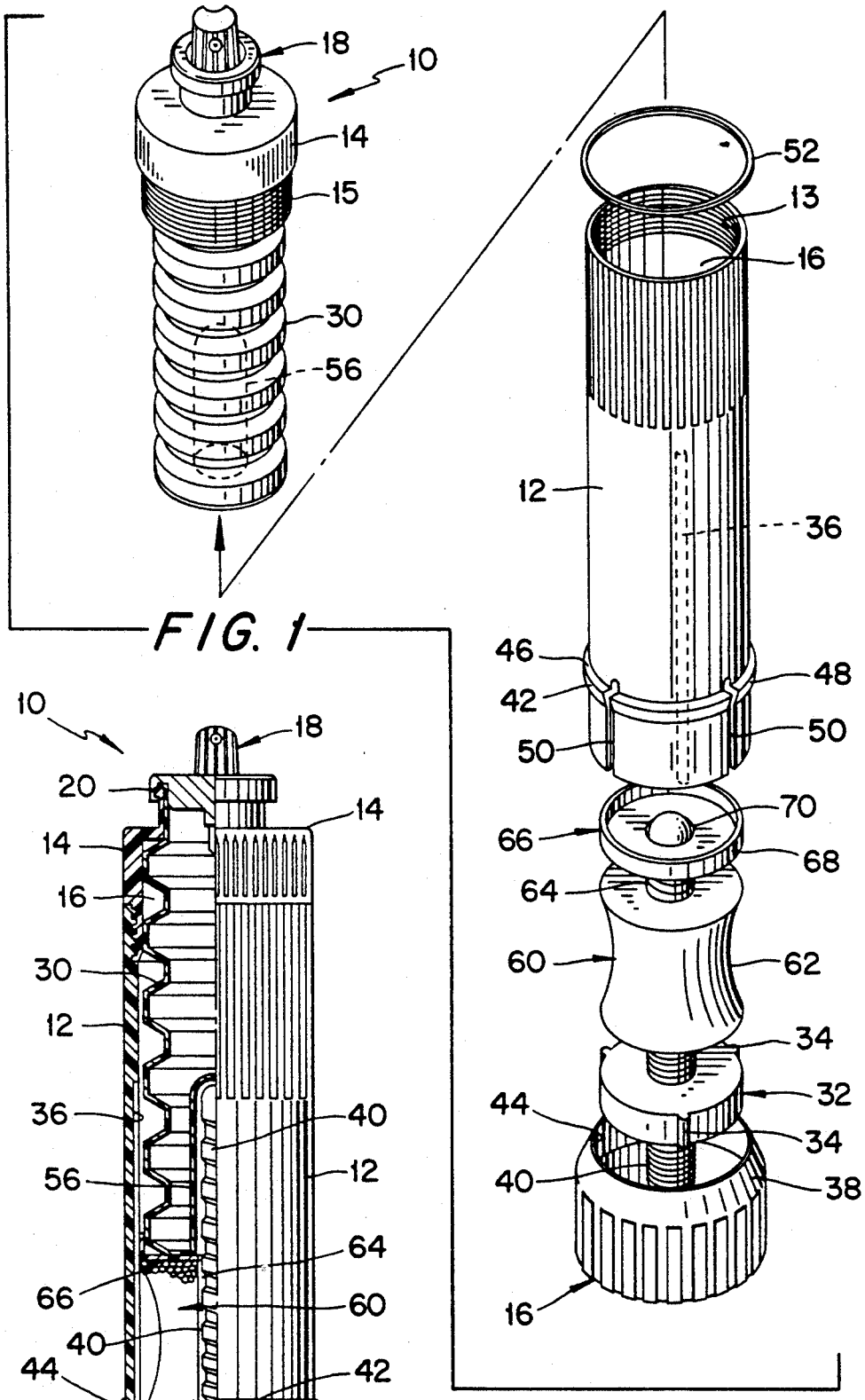
FIG. 1 is an exploded perspective view of a dispenser according to the present invention.
FIG. 2 is a side elevational view of the dispenser depicted in FIG. 1, with half of the dispenser depicted in longitudinal section.

A spray dispenser 10 comprises a cylindrical container 12 forming an inner compartment 16. At its upper end, the container 12 includes an internal screw thread 13 to which is connected an external screw thread 15 of a removable cap 14. The cap 14 carries a conventional manually actuable valve assembly 18. A peripheral edge 20 of the valve assembly 18 is bent around an upper end of the cap 14.

Depending from the cap 14 is a product bag 30 formed of a flexible material in which a liquid product is carried. An upper end of the bag 30 is sandwiched between the cap 14 and the valve assembly 18, whereby the cap 14, the valve assembly 18, and the bag 30 form a product assembly which can be removed from, or inserted into, the container 12 as a unit.

The bag 30 may be constructed of a bellows configuration of the type disclosed in commonly assigned U.S. Ser. No. 07/727,661 filed Jun. 19, 1991, the disclosure of which is incorporated herein by reference. By unscrewing the cap 14, an empty product assembly can be removed and replaced by an identical full product assembly.

Slidably mounted within the container 12 is a piston 32. The piston 32 comprises a cylindrical disc having a plurality of radially projecting lugs 34. The lugs 34 are slidably received in respective longitudinal grooves 36 formed in the inner surface of the cylinder 12. Hence, the piston 32 is movable longitudinally within the cylinder 12, but cannot rotate therein.

Attached to a lower end of the container 12 is a piston drive member 36 which includes an outer sleeve 38 and an inner longitudinal post 40. The sleeve 38 is attached to the container 12 for rotation relative thereto. The outer surface of the container 12 includes a generally annular projection 42, and the upper end of the sleeve 38 includes a radial shoulder 44 which overlies the projection 42 to retain the sleeve on the cylinder. The shoulder 44, and an upper face 46 of the projection extend radially. A lower face 48 of the projection is inclined, so that when the sleeve is pushed upwardly along the container 12, the upper end of the sleeve will be cammed by the lower face 48 of the projection and will thus slide past the projection. The projection can then snap outwardly to retain the sleeve in place. This action is promoted by providing the lower end of the container 12 with longitudinal slots 50 which extend upwardly from the lower end of the container past the projection 42. The slots promote inward flexing of the cylinder and projection as the sleeve slides past the projection.

A washer 52 can be interposed between the shoulder 44 and the projection 42 if desired.

The post 40 includes an external thread which mates with an internal thread formed on a central hole extending through the piston 32. Thus, when the sleeve 38 and post 40 are rotated, the piston moves longitudinally within the container. The thread on the post is preferably formed with about six turns per inch. Thus, it is only necessary for a user to rotate the sleeve 38 three times in order to displace the piston by one-half inch.

The post 40 extends upwardly past the lower end of the bag 30 prior to compression of the bag when the bag is full. To accommodate the upper end of the post, the lower end of the bag is formed with a downwardly open central cavity 56.

Disposed atop the piston 32 is an energy storing member in the form of a closed-cell plastic foam element 60 wherein at least a substantial majority of the cells thereof are closed. Attention is directed to copending application Ser. No. 07/851,804, filed Mar. 16, 1992 for a disclosure of such an energy storage member. The disclosure of that application is incorporated herein by reference. Foams of that type are characterized by a multitude of tiny, gas-filled, closed cells encased within a plastic matrix or bonding agent, such as urethane for example. When the foam is compressed, the gas-filled cells are collapsed, thereby storing energy to pressurize the bag 30 which is situated above the foam element. As the product is discharged, the cells expand, thereby dissipating the stored energy. One type of such foam which has been found acceptable is that manufactured and sold by Freudenberg-NOK of Plymouth, Mich. under the designation AUZ 2500.

The closed-cell foam behaves like an elastomer and has very low compression set. Since the internal gas cells are collapsed when the foam is compressed, there occurs little lateral bulging of the element. By providing the foam element 60 in a generally cylindrical form with an appropriately sized concave side wall 62, any lateral (radial) bulging which occurs during compression will not increase the diameter of the element appreciably beyond its original maximum diameter. Accordingly, there is no need to provide an appreciable radial gap between the foam element 60 and the inner surface of the container 12.

By varying the size of the foam cells and the type of matrix material, the density and stiffness of the foam element can be changed. By selecting a suitable density and stiffness, as well as a suitable height of the foam element, the foam element can be tailored to properly pressurize liquid products of a wide variety of viscosities, in order to achieve suitable discharge flow volumes of the products.

Since the foam element exhibits little lateral bulging when compressed (as compared for example to a solid elastomeric body), the foam element can be used in a confined (compact) space. By properly shaping the side(s) of the foam element, it can be ensured that the foam element will not expand laterally beyond its original maximum diameter. By a proper selection of cell size, matrix material, and foam element height, the product-energizing characteristics of the foam can be adapted to products of different viscosities.

The foam element 60 includes a central hole 64 through which the post 40 extends. A cup-shaped disc 66 is disposed between an upper end of the foam element and a lower end of the bag. An upwardly extending outer rim 68 of the disc 66 engages the inside surface of the cylinder 12 to prevent the disc from becoming skewed as it travels upwardly within the container and to keep the lower end of the bag 30 from being pinched between the outer periphery of the foam element 60 and the inner surface of the cylinder 12. Such pinching could result in the bag being ruptured. The disc 66 includes a small central hole 70 through which the post 40 projects.

IN OPERATION, the dispenser 10 is purchased as depicted in FIG. 2, with the bag 30 containing a liquid product. The bag could be pre-pressurized, or the user could pressurize the bag by rotating the sleeve 38 in one direction. The accompanying rotation of the post 40 causes the piston 32 to travel upwardly and push the foam element 60 against the lower end of the bag 30. As a result, the bag 30 is compressed to eliminate any voids between the liquid and the volume of the bag. Also, the foam element 60 becomes compressed to store energy for continuously pressurizing the liquid. Once the user encounters appreciable resistance to further rotation, the dispenser can be set aside for future use, or can be used immediately by actuating the valve assembly 18. The compressed liquid in the bag 30 will be expelled, preferably as a spray, until the foam element 60 expands to its relaxed or non-compressed state. Then, the sleeve 38 can be rotated to recompress the foam element.

Due to the relatively low number of thread turns per inch of post length (e.g., six), it is not necessary to rotate the sleeve many times to recompress the foam element. The disc 66 prevents the bag from being pinched between the foam element, and the post and between the foam element and the cylinder 12.

Eventually, all of the liquid product will be dispensed, and the upper end of the container will be occupied by the fully compressed bag 30 and the foam element 60. The upper ends of the grooves 36 terminate at that point to prevent further upward travel of the piston 32. The upper ends of the grooves 36 coincide generally with the upper end of the post.

Once all of the product has been discharged from the bag 30, a product refill assembly can be installed by unscrewing the cap 14 from the container 12, removing the depleted product assembly 14, 18, 30, and inserting a new filled product assembly. The sleeve 38 will have been rotated in a reverse direction to lower the piston 32, foam element 60, and disc 66 in order to provide sufficient room for receiving the bag 30 of the new product assembly.

The bag 30 is formed of a sufficiently stiff material, such as polyethylene or polypropylene, so that the cavity 56 retains its shape sufficiently to receive the upper end of the post 40. The upper end of the post is of a relatively blunt, tapered configuration, such as spherical, to facilitate its entry into the cavity.

The foam element 60 is capable of being compressed and expanded many times without losing its elasticity, so the container is capable of many reuses, thereby minimizing the amount of waste, since only the product assembly needs to be discarded after each emptying of the dispenser.

The components of the container can be formed of a wide variety of materials. The bag 30 and foam element 60 are formed of plastic material, whereas the remaining components can be formed of any suitably strong material such as metal or plastic.

Although the present invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A dispenser comprising:

a container;

valving means mounted at an upper longitudinal end of said container and including a discharge outlet;

a liquid product-containing flexible bag disposed in said container such that liquid product therein communicates with said discharge outlet;

a piston disposed in said container below said bag for non-rotational longitudinal movement, said piston including an internally threaded central through-hole;

an elastically deformable closed-cell foam element disposed in said container between said bag and said piston, said foam element including a central through-hole; and manual actuating means for raising said piston, including:

a drive portion exposed for manual rotation about a longitudinal axis adjacent a lower end of said container, and an externally threaded post joined to said drive portion and extending longitudinally upwardly through said through-holes of said piston and said foam element, an upper end of said post terminating within a cavity disposed in a lower end of said bag, said post being threadedly connected to said internally threaded through-hole of said piston, such that rotation of said post in one direction raises said piston to compress said foam element and pressurize liquid product in said bag.

2. A dispenser according to claim 1, wherein said bag has a bellows configuration, said cavity comprising a preformed cavity in said bellows.

3. A dispenser according to claim 1, wherein said drive portion comprises a sleeve arranged coaxially relative to said container around an outer periphery thereof, an inner surface of said sleeve including a downwardly facing shoulder, said outer periphery of said container including an upwardly facing surface disposed beneath said downwardly facing shoulder for retaining said sleeve against longitudinal dislodgement from said container while permitting said sleeve to rotate relative to said container about said longitudinal axis.

4. A dispenser according to claim 1, wherein said upper end of said post is blunt and convexly curved.

5. A dispenser according to claim 1, wherein there are about six thread turns per inch on said externally threaded post.

6. A dispenser according to claim 1, wherein an upper end of said foam element terminates below said cavity.

7. A dispenser according to claim 1, wherein said foam element comprises a closed-cell urethane foam element.

8. A dispenser according to claim 1, wherein said foam element is of generally cylindrical shape with a concave side wall.

9. A dispenser according to claim 1, wherein said foam element is situated entirely outside of said cavity during the entire extent of upward travel of said foam element.

10. A dispenser according to claim 1, wherein said piston and said container are interconnected by a projection-and-groove connection for preventing rotation of said piston.

11. A dispenser according to claim 10, wherein said projection-and-groove connection comprises radial projections on said piston and longitudinal grooves formed in an inner surface of said container, said projections being longitudinally slidably disposed in said grooves.

12. A dispenser according to claim 1 including a stiff disc interposed between an upper end of said foam element and a lower end of said bag, said disc including a central through-hole through which said post extends.

13. A dispenser according to claim 12, wherein said disc includes an upwardly extending outer edge which slides along an inner surface of said container.

14. A dispenser according to claim 1, wherein said valving means and said bag are removable as a unit from said container, and are replaceable by a similar filled unitary valving means and bag.

15. A dispenser according to claim 14 including a cap threadedly connected to an upper end of said container, said valving means and bag being connected to said cap such that said cap is removable as a unit with said valving means and said bag, and are replaceable by a similar unitary cap, valving means and bag.

16. A dispenser according to claim 15, wherein said cap includes external threads joined to internal threads of said container.

17. A dispenser comprising:

a cylindrical container;

a cap threadedly mounted adjacent an upper end of said container;

valving means mounted to said cap and including a discharge outlet;

a liquid product-containing flexible bag disposed in said container such that liquid product therein communicates with said discharge outlet, said bag being of bellows configuration and including an upwardly closed, downwardly open longitudinal cavity at its lower end;

said cap, said valving means and said bag being interconnected to be removable as a unit from said container and replaced by a similar unitary cap, valving means and bag;

a piston disposed in said container below said bag for non-rotational, longitudinal movement in said container, said piston including an internally threaded central through-hole;

an elastically deformable closed-cell foam element disposed in said container between said bag and said piston and including a central through-hole; an upper end of said foam element terminating below said cavity;

a stiff disc disposed between said upper end of said foam element and a lower end of said bag, said disc including a central through-bore; and manual actuating means for raising and lowering said piston, including:

a drive portion exposed for manual rotation about a longitudinal axis adjacent a lower end of said container, and an externally threaded post joined to said drive portion and extending longitudinally upwardly through said through-holes of said piston, said disc and said foam element, an upper end of said post terminating in said cavity, said post being threadedly connected to said internally threaded through-hole of said piston, such that rotation of said post in one direction raises said piston to compress said foam element and pressurize liquid product in said bag.

18. A dispenser according to claim 17, wherein said piston and said container are interconnected by a projection-and-groove connection for preventing rotation of said piston.

19. A dispenser according to claim 17, wherein said drive portion comprises a sleeve arranged coaxially relative to said container around an outer periphery thereof, an inner surface of said sleeve including a downwardly facing shoulder, said outer periphery of said container including an upwardly facing surface disposed beneath said downwardly facing shoulder for retaining said sleeve against longitudinal dislodgement from said container while permitting said sleeve to rotate relative to said container about said longitudinal axis.

20. A dispenser according to claim 17, wherein said disc includes an upwardly extending outer edge which slides along an inner surface of said container.

21. A dispenser according to claim 17, wherein said foam element is situated entirely outside of said cavity during the entire extend of upward travel of said foam element.

22. A dispenser according to claim 21, wherein said disc is situated entirely outside of said channel during the entire extend of upward travel of said disc.

* * * * *